United States Patent [19]

Christoperson

[11] 4,453,718

[45] Jun. 12, 1984

[54] SWIVEL SWITCH GAME

[76] Inventor: Dale Christoperson, 1700-31st St., Kenosha, Wis. 53140

[21] Appl. No.: 379,181

[22] Filed: May 17, 1982

[51] Int. Cl.[3] ..... A63F 3/00

[52] U.S. Cl. ..... 273/249; 273/284

[58] Field of Search ..... 273/280, 282, 283, 284, 273/249, 258, 243, 287

[56] References Cited

U.S. PATENT DOCUMENTS 3,860,242 1/1975 Martin ..... 273/275

4,174,840 11/1979 Curtiss ..... 273/243

FOREIGN PATENT DOCUMENTS 562262 6/1944 United Kingdom ..... 273/284

694880 7/1953 United Kingdom ..... 273/284

*Primary Examiner*—Richard C. Pinkham

*Assistant Examiner*—Matthew L. Schneider

*Attorney, Agent, or Firm*—Ronald E. Barry

[57] ABSTRACT

A chance game including a game board having a plurality of spaces arranged to provide diverse paths of travel. The game also includes a number of auxilliary boards pivotally mounted on the game board, each auxilliary board including a plurality of spaces arranged to provide extended paths of travel on said game board. The game further includes a number of game pieces adapted to be moved along the paths of travel, a first chance device for determining the number of spaces of advance for the game pieces and a second chance device for determining the position of the auxilliary boards.

5 Claims, 5 Drawing Figures

SWIVEL SWITCH GAME

BACKGROUND OF THE INVENTION

The present invention relates generally to board games which utilize chance devices to determine the movement of playing pieces on the game board. The conventional board game usually includes a playing piece for each player of the game, the game board having a plurality of playing stations thereon defining paths of travel for the playing pieces and at least one chance device for determining the advance of the pieces on the game board. As the playing pieces are advanced along the paths of travel on the game board the players act according to the indicia printed on the various playing stations in conjunction with the rules of the particular game.

SUMMARY OF THE INVENTION

The present invention provides a new and unique board game which employs one chance device which determines the advance of the playing piece of a player and a second chance device actuated by the player which determines the paths of travel for the playing piece of the next player. This is accomplished by a unique game board which has a fixed path of travel defined by a plurality of spaces marked on the game board and a number of moveable boards each having a fixed path of travel. The moveable boards being mounted for pivotal movement between first and second positions with respect to the fixed paths of travel to alter or change the fixed paths of travel on the game board.

Each player of the game has at least one chance piece in a distinctive form which is used to indicate the player's position along the path of travel from start to finish on the game board. The chance pieces are advanced in response to a chance device having numerical indicia on the faces thereof which is thrown in turn by each player to move his/her chance device.

The second chance device including a rotary pointer for determining the numerical indicia of the auxiliary board which is to be moved before the next player starts his play. Each auxiliary board includes a numerical indicia corresponding to the numerical indicia on the rotary chance device. On actuation of the chance device, the auxiliary board corresponding to the numerical indicia indicated by the pointer is moved either from the first position to the second position or from the second position to the first position.

DESCRIPTION OF THE PREFERRED EMBODIMENT

Figure 1:
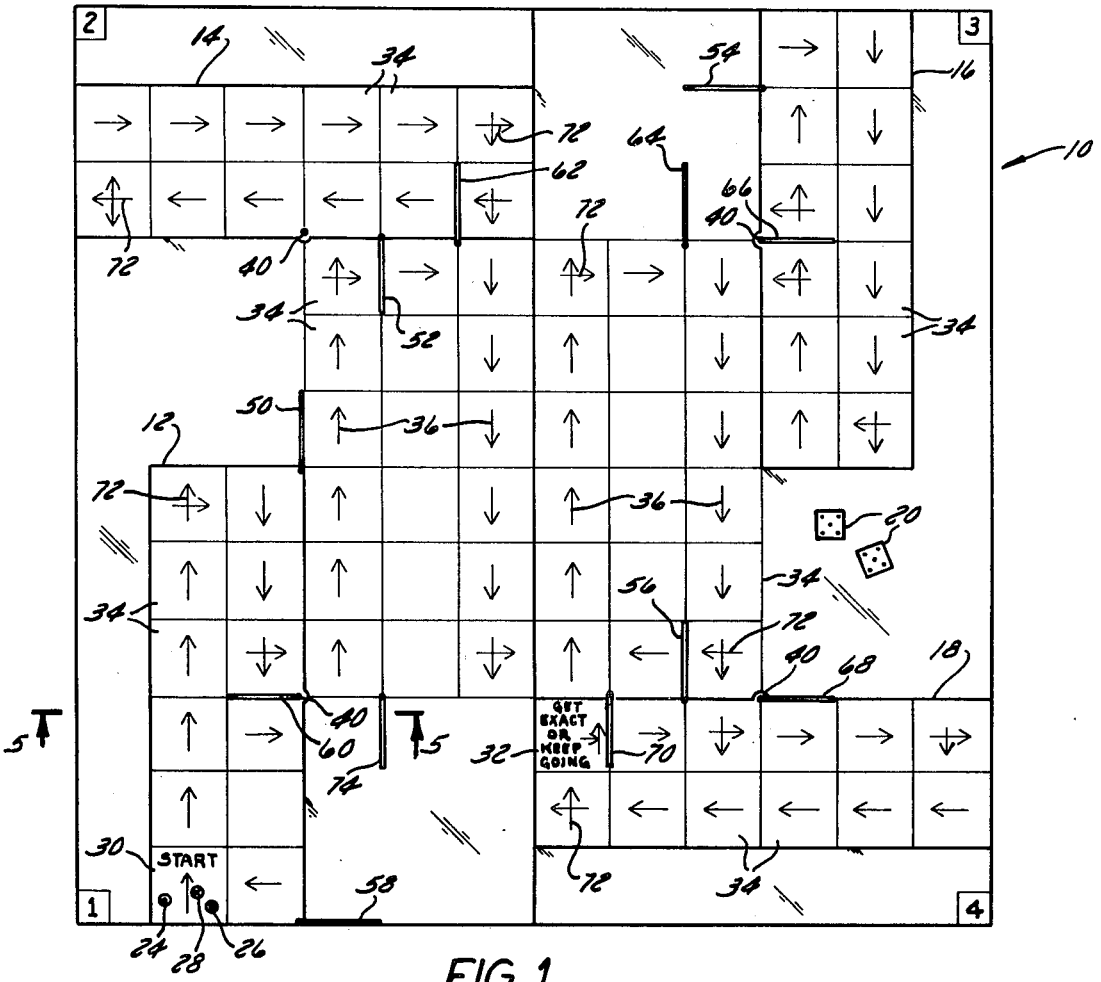
FIG. 1 is a top plan view of the board game of the present invention with all of the auxiliary boards shown in their first position.
Figure 2:
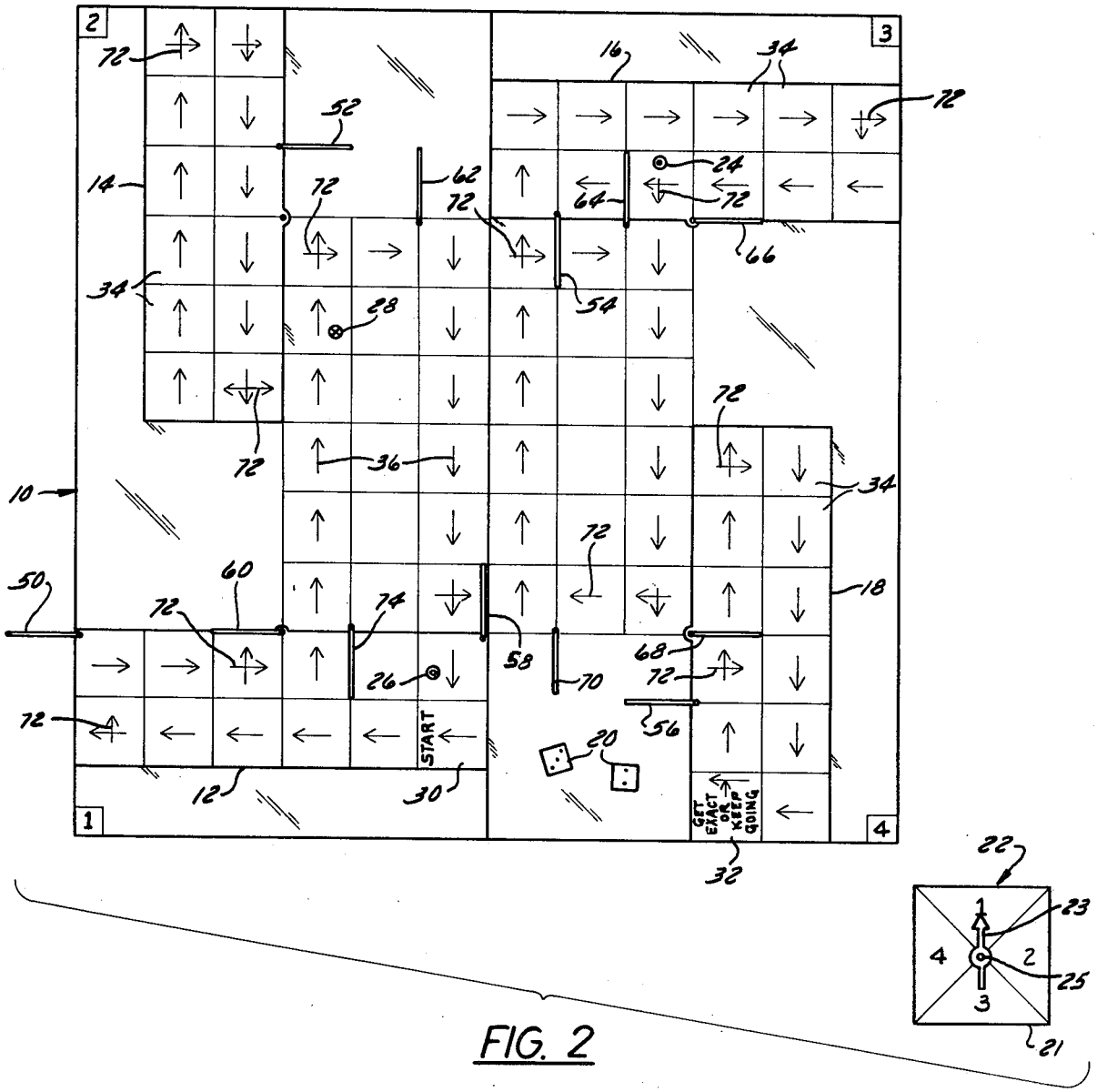
FIG. 2 is a top plan view of the board game shown in FIG. 1 with all of the auxiliary boards shown moved from the first position to a second position.
Figure 5:
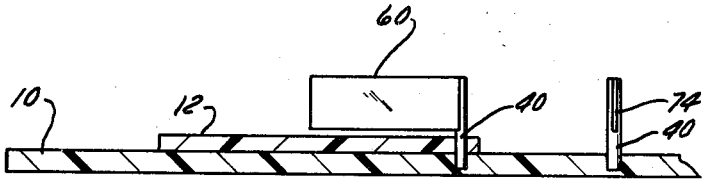
FIG. 5 is a section view of a portion of the game board taken on line 5—5 of FIG. 1.

The game of the present invention as seen in FIGS. 1 and 2 generally includes a game board 10, a plurality of auxiliary boards 12, 14, 16, and 18, a first chance device in the form of a pair of dice 20, a second chance device in the form of a rotary spinner 22 and a plurality of playing pieces 24, 26 and 28 for each player of the game. According to the rules of the game, in utilizing the elements above listed, the object of the game is for a player to move a chance piece from a starting square 30 on auxiliary board 12 following the paths of travel defined by the squares on the game board and the squares on the auxiliary boards to the finish square 32, on auxiliary board 18.

The game board 10 has thirty-six squares 34 printed thereon with arrows 36 printed on the various squares 34 to define a path of travel back and forth on the game board for the playing pieces 24, 26 and 28. Each of the auxiliary boards 12, 14, 16 and 18 include twelve squares 34 with arrows 36 defining paths of travel for the playing pieces 24, 26 and 28. The auxiliary boards form continuations of the paths of travel on the game board 10 or the paths of travel on the adjacent auxiliary boards depending on the particular position of the auxiliary boards.

In this regard and referring to FIG. 1, each of the auxiliary boards 12, 14, 16 and 18 is pivotally mounted on the game board by means of pins 40 on the game board 10. The boards, 12, 14, 16 and 18 are shown located in the first or start position of the game. The first square 30 on the first board 12 is the starting point for the game. The last square 32 on the fourth board 18 is the end of the game.

Figure 4:
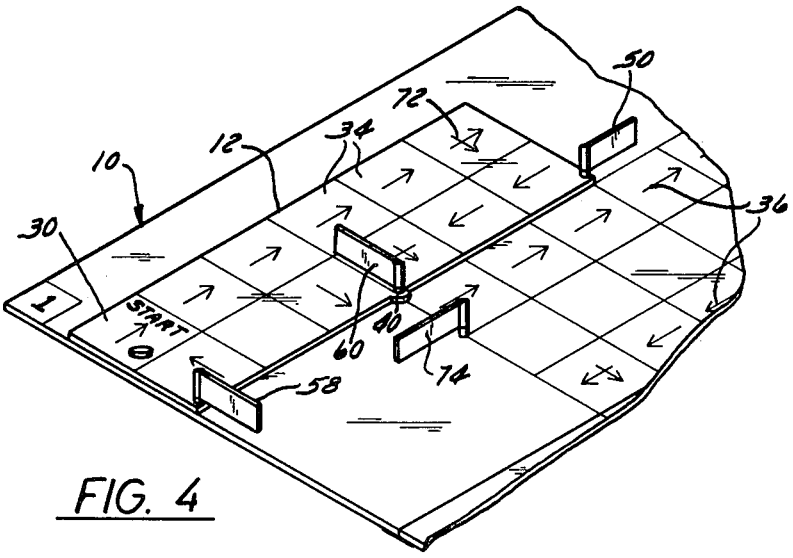
FIG. 4 is a perspective view of a portion of the game board showing the barriers used for directing the chance pieces on the paths of travel on the boards.
Figure 3:
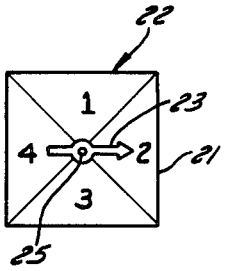
FIG. 3 is a top plan view of a rotary chance device having numerical indicia corresponding to the indicia for the auxiliary boards.

The paths of travel on the game board 10 and on the auxiliary boards 12, 14, 16 and 18 are interrupted by means of moveable barriers or flags 50, 52, 54, 56 and 58 carried by the auxiliary boards or by means of fixed barriers or flags 60, 62, 64, 66, 68 and 70 mounted on the game board 10. Indicia means are provided on the squares 34 to indicate the path of travel when a player piece reaches the edge of one of the boards or is stopped by one of the barriers. Such means is in the form of alternate direction arrows 72. Referring to FIG. 4, the first board 12 is shown having two moveable barriers 50 and 58. Two fixed barriers 60 and 74 are shown mounted on the game board 10. The two fixed barriers 60 and 74 are shown mounted on pins 40 in the game board 10.

Referring to FIG. 1, the first board 12 is shown in the first position. A player piece 24 advanced from start square 30 is moved in a straight line to the end of the board 12 where the alternate direction arrow 72 directs the next move to the next path of travel indicated by arrows 36. The direction of travel is then reversed until the player piece reaches the barrier 60. The player piece is then directed to move to the game board 10 by arrow 72. The direction of advance is reversed again as indicated by the arrows 36.

Referring to FIG. 2, the first board 12 is shown in the second position. A player piece advanced on the board 12 will again be diverted to the game board 10 by barrier 74. It should also be noted that player pieces advanced on the game board 10 will be diverted to the auxiliary board by barrier 58.

The second board 14, as seen in FIG. 1, is shown in the first position and player pieces advanced on game board 10 will be diverted to the second board 14 by barrier 52. Player pieces advanced on the second board 14 will be diverted to the game board 10 by the barrier 62. When the second board 14 is moved to the second position, FIG. 2, a player piece advanced to the end of the board 14 will follow direction arrow 72 to the game board 10.

If the first board 12 is in the first position, FIG. 1, and the second board 14 is in the second position player pieces advanced to the end of the first board will continue on its path of travel on the second board. When its player piece reaches the end of the second board the player piece will be directed to the first board 12 by barrier 50 and to the game board 10 by barrier 60.

Player pieces advanced on the third board 16 when in the first position, FIG. 1, will be diverted to the game board 10 by barrier 66. When the third board 16 is moved to the second position, FIG. 2, player pieces advanced on the game board will be directed by arrow 72 from the game board 10 to the third board 16 by barrier 54. Player pieces advanced on the third board 16 will be directed by arrow 72 to the game board 10 at barrier 64. If the second board 14 is in the first position when the third board 16 is in the second position, player pieces advanced on the second board 14 will be moved along the outside column directly to the third board 16 and from the third board 16 to the second board 14.

Player pieces advanced on the fourth board 18 when in the first position, will normally be moved toward the finish square 34, however, if the number of moves is not exact, the player pieces will be directed by barrier 70 back to the game board 10. Player pieces advanced on the game board 10 will be directed by barrier 56 into the fourth board 18. If the first board 12 is in the second position and the fourth board 18 is in the first position, player pieces advanced on the fourth board will be advanced to the first board.

If the fourth board 18 is in the second position and the third board 16 is in the first position, player pieces can advance directly from the third board 16 to the fourth board 18 and from the fourth board 18 to the third board 16.

Player pieces are advanced by means of the dice 20 which are thrown by the player to indicate the number of squares to be advanced by the player piece. At the start of play, the auxiliary boards should all be located in the first position shown in FIG. 1. After the first player has thrown the dice and moved the player piece, the first player will then operate the second chance device 22 to move one of the auxiliary boards from the first position to the second position.

In this regard, the second chance device includes a base 21 having four quarters marked with the indicia 1, 2, 3 or 4. Means in the form of a pointer 23 is mounted for rotary motion on a pin 25 on the base 21 to indicate the indicia on the base. After a player has advanced a chance piece, the player rotates the pointer 23. The outer board having the number corresponding to the number indicated by the pointer 23 is then moved either from the first position to the second position or from the second position to the first position. The paths of travel are thus changed for the next player. This procedure is repeated until a player has advanced a player piece to the square 32 on auxiliary board 18.

Although two dice and three player or chance pieces have been described in the play of the game, variations in the number of dice or pieces can be employed in playing the game. For example, the game can be played with one die and four pieces or any other number as described.

I claim:

1. A game including a game board having four corners and lines of spaces providing paths of travel for game pieces, a plurality of auxiliary boards each having lines of spaces arranged to provide alternate paths of travel for the game pieces and one edge of each auxiliary board being pivotally connected to a corner of said game board for movement between a first position having one portion of said edge of said auxiliary board positioned along one edge of said game board and a second position having the other portion of said edge of said auxiliary board positioned along a different edge of said game board, each of said auxiliary boards including an identifying indicia thereon, a rotatable dial indicator having a plurality of identifying spaces corresponding to the identifying indicia on said auxiliary boards, selected ones of said identifying spaces having indicia corresponding to the indicia on said auxiliary boards, said rotatable dial indicator including a dial capable of rotating to indicate by chance one of the indicia on the indicator that corresponds to the identifying indicia on one of said auxiliary boards whereby said auxiliary board containing said corresponding indicia is moved from one of the positions to the other position thereby changing the path of travel for the game pieces and at least one multi-faceted element having a numbered indicia on each of said facets to indicate the number of spaces for advancing a game piece.

2. A chance game including a game board having four corners and a number of paths of travel thereon, an auxiliary board having one edge connected to one of the corners of the game board for pivotal movement between a first position having one portion of the edge of said auxiliary board located along one edge of said game board and a second position having a second portion of the edge of said auxiliary board located along a different edge of said game board, each of said auxiliary boards having paths of travel defining diverse paths of travel when aligned with the paths of travel on said game board, a number of game pieces adapted to be moved along the paths of travel on said game board and said auxiliary boards, a first chance device for determining the movement of the game pieces on the paths of travel, and a second chance device for determing the positions of the auxiliary boards.

3. The chance game according to claim 2 wherein said paths of travel are defined by rows of spaces each having indicia marked therein for indicating the direction of travel for the game pieces.

4. The chance game according to claim 3 wherein said plurality of auxiliary game boards includes four boards each having the same number of spaces marked thereon.

5. The chance game according to claims 2, 3 or 4 including barriers mounted on said game board and auxiliary boards for obstructing the paths of travel to change the direction of a player piece.

* * * * *